US006517699B2

(12) United States Patent
Shimohira et al.

(10) Patent No.: US 6,517,699 B2
(45) Date of Patent: Feb. 11, 2003

(54) METHOD FOR PRODUCING POLYSULFIDES BY MEANS OF ELECTROLYTIC OXIDATION

(75) Inventors: Tetsuji Shimohira, Kanagawa (JP); Tatsuya Andoh, Kanagawa (JP); Junji Tanaka, Kanagawa (JP); Keigo Watanabe, Yamaguchi (JP); Yasunori Nanri, Yamaguchi (JP)

(73) Assignees: Asahi Glass Company, Limited, Tokyo (JP); Kawasaki Kasei Chemicals Ltd., Tokyo (JP); Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 09/938,579

(22) Filed: Aug. 27, 2001

(65) Prior Publication Data

US 2002/0053520 A1 May 9, 2002

Related U.S. Application Data

(63) Continuation of application No. PCT/JP00/01147, filed on Feb. 28, 2000.

(30) Foreign Application Priority Data

Feb. 26, 1999 (JP) ..... 11-051033

(51) Int. Cl.[7] ..... C25B 3/00; C25B 1/00; C02F 1/461; C12Q 1/00

(52) U.S. Cl. ..... 205/414; 205/444; 205/554; 205/494; 205/746; 205/758; 205/759; 205/776

(58) Field of Search ..... 205/414, 444, 205/554, 494, 746, 758, 759, 770

(56) References Cited

U.S. PATENT DOCUMENTS

| | | | | | |
|---|---|---|---|---|---|
| 5,624,545 | A | * | 4/1997 | Landfors et al. | 205/746 |
| 5,653,861 | A | * | 8/1997 | Landfors et al. | 205/746 |
| 5,972,197 | A | * | 10/1999 | Andoh et al. | 205/554 |
| 6,264,819 | B1 | | 7/2001 | Andoh et al. | 205/494 |

FOREIGN PATENT DOCUMENTS

| | | |
|---|---|---|
| WO | WO 95/00701 | 1/1995 |
| WO | WO 97/01456 | 11/1997 |
| WO | WO 97/41295 | 11/1997 |

* cited by examiner

*Primary Examiner*—Edna Wong
(74) *Attorney, Agent, or Firm*—Oblon, Spivak, McClelland, Maier & Neustadt, P.C.

(57) ABSTRACT

The present invention has an object to obtain a cooking liquor containing polysulfide-sulfur at a high concentration by minimizing by-production of thiosulfate ions. The present invention is a method for producing polysulfides, which comprises introducing a solution containing sulfide ions into an anode compartment of an electrolytic cell comprising the anode compartment provided with a porous anode, a cathode compartment provided with a cathode, and a diaphragm partitioning the anode compartment and the cathode compartment, for electrolytic oxidation to obtain polysulfide ions, characterized in that the porous anode is disposed so that a space is provided at least partly between the porous anode and the diaphragm, and the apparent volume of the porous anode is from 60% to 99% based on the volume of the anode compartment.

26 Claims, No Drawings

METHOD FOR PRODUCING POLYSULFIDES BY MEANS OF ELECTROLYTIC OXIDATION

This application is a Continuation of application International application No. PCT/JP00/01147 filed on Feb. 28, 2000, pending which was not published in English.

1. Technical Field

The present invention relates to a method for producing polysulfides by electrolytic oxidation. Particularly, it relates to a method for producing a polysulfide cooking liquor by electrolytically oxidizing white liquor or green liquor in a pulp production process.

2. Background Art

It is important to increase the yield of chemical pulp for effective utilization of wood resources. A polysulfide cooking process is one of techniques to increase the yield of kraft pulp as the most common type of chemical pulp.

The cooking liquor for the polysulfide cooking process is produced by oxidizing an alkaline aqueous solution containing sodium sulfide, i.e. so-called white liquor, by molecular oxygen such as air in the presence of a catalyst such as activated carbon (e.g. the following reaction formula 1) (JP-A-61-259754 and JP-A-53-92981). By this method, a polysulfide cooking liquor having a polysulfide sulfur concentration of about 5 g/l can be obtained at a selectivity of about 60% and a conversion of 60% based on the sulfide ions. However, by this method, if the conversion is increased, thiosulfate ions not useful for cooking, are likely to form in a large amount by side reactions (e.g. the following reaction formulae 2 and 3), whereby it used to be difficult to produce a cooking liquor containing polysulfide sulfur at a high concentration with a high selectivity.

$$4Na_2S+O_2+2H_2O \rightarrow 2Na_2S_2+4NaOH \quad (1)$$

$$2Na_2S+2O_2+H_2O \rightarrow 2Na_2S_2O_3+2NaOH \quad (2)$$

$$2Na_2S_2+3O_2 \rightarrow 2Na_2S_2O_3 \quad (3)$$

Here, polysulfide sulfur which may be referred to also as PS-S, is meant for sulfur of 0 valency in e.g. sodium polysulfide $Na_2S$, i.e. sulfur of (x−1) atoms. Further, in the present specification, sulfur corresponding to sulfur having oxidation number of −2 in the polysulfide ions (sulfur of one atom per $S_x^{2-}$) and sulfide ions ($S^{2-}$) will generically be referred to as $Na_2S$-state sulfur. In the present specification, the unit liter for the volume will be represented by l.

On the other hand, PCT International Publication WO95/00701 discloses a method for electrolytically producing a polysulfide cooking liquor. In this method, as an anode, a substrate surface-coated with an oxide of ruthenium, iridium, platinum or palladium, is used. Specifically, a three-dimensional mesh electrode composed of a plurality of expanded-metals is disclosed. Further, PCT International Publication WO97/41295 discloses a method for electrolytically producing a polysulfide cooking liquor by the present applicants. In this method, as the anode, a porous anode at least made of carbon is used, particularly an integrated body of carbon fibers having a diameter of from 1 to 300 $\mu$m is used.

It is an object of the present invention to produce a cooking liquor containing polysulfide ions at a high concentration by an electrolytic method from a solution containing sulfide ions, particularly white liquor or green liquor in a pulp production process at a high selectivity with a low electrolytic power while minimizing by-production of thiosulfate ions. Further, it is an object of the present invention to provide a method for producing a polysulfide cooking liquor under such a condition for the electrolytic operation that the pressure loss is small and clogging is minimum.

DISCLOSURE OF THE INVENTION

The present invention provides a method for producing polysulfides, which comprises introducing a solution containing sulfide ions into an anode compartment of an electrolytic cell comprising the anode compartment provided with a porous anode, a cathode compartment provided with a cathode, and a diaphragm partitioning the anode compartment and the cathode compartment, for electrolytic oxidation to obtain polysulfide ions, characterized in that the porous anode is disposed so that a space is provided at least partly between the porous anode and the diaphragm, and the apparent volume of the porous anode is from 60% to 99% based on the volume of the anode compartment.

BEST MODE FOR CARRYING OUT THE INVENTION

In the present invention, the porous anode is disposed so that a space is provided at least partly between the porous anode and the diaphragm, and the apparent volume of this porous anode is from 60% to 99% based on the volume of the anode compartment. Here, the volume of the anode compartment is the volume of a space defined by the effective current-carrying surface of the diaphragm and an apparent surface of the portion of the stream of an anode solution most distanced from the diaphragm, in other words, an apparent surface of the portion of the anode solution stream which flows most distantly from the diaphragm. The space to be formed between the anode and the diaphragm, may be formed over the entire effective current-carrying surface or may be formed at a part thereof. In a case where clogging is likely to take place when a solid component having a large particle size enters into the electrolytic cell, this space is preferably continuous as a flow path. If this apparent volume exceeds 99%, the pressure loss tends to be large on the electrolytic operation, or suspended substances are likely to cause clogging, such being undesirable. If the apparent volume is less than 60%, the amount of the anode solution flowing through the porous anode tends to be too small, whereby the current efficiency tends to be poor, such being undesirable. Within this range, the electrolytic operation can be carried out with a small pressure loss without clogging while maintaining a good current efficiency. This value is more preferably set to be from 70 to 99%.

Further, the present inventors have found that a space on the diaphragm side will provide an unexpected effect. It is considered that the electrode reaction of the anode in the present invention takes place substantially over the entire surface of the porous anode, but at a portion of the anode close to the diaphragm, the electric resistance of the solution is small, and the current tends to flow readily, whereby the reaction proceeds preferentially. Accordingly, at such a portion, the reaction tends to be mass transfer rate controlling step, whereby by-products such as thiosulfate ions or oxygen, tend to form, or dissolution of the anode is likely to occur. However, if a space is provided between the porous anode and the diaphragm, the linear velocity of the anode solution through this space tends to be high, the flow rate of the solution at a portion on the diaphragm side of the anode increases as induced by this flow, and the material diffusion at the portion of the anode close to the diaphragm will be advantageous, whereby it is possible to effectively control the side reactions.

Further, by this space, the flow of the anode solution tends to be smooth, and there will be a merit that deposition tends to scarcely accumulate on the anode side surface of the diaphragm.

As the porous anode to be used in the present invention, those having various shapes or made of various materials may be employed. Specifically, carbon fibers, carbon felts, carbon papers, metal foams, meshed metals or meshed carbon, may, for example, be mentioned. A metal electrode having modification with e.g. platinum applied to the surface, is also suitably employed.

In the present invention, the above electrolytic operation is preferably carried out under such a pressure condition that the pressure in the anode compartment is higher than the pressure in the cathode compartment. If the electrolytic operation is carried out under such a condition, the diaphragm will be pressed to the cathode side, and the above-mentioned space can readily be provided between the porous anode and the diaphragm.

The porous anode of the present invention preferably has a physically continuous three-dimensional network structure. The three-dimensional network structure is preferred, since it is thereby possible to increase the anode surface area, and the desired electrolytic reaction takes place over the entire surface of the electrode, and formation of by-products can be controlled. Further, the anode is not an integrated body of fibers, but has a physically continuous network structure, whereby it exhibits adequate electrical conductivity as the anode, and IR drop at the anode can be reduced, and accordingly, the cell voltage can further be lowered.

The network structure is a physically continuous structure and may be continuously bonded, for example, by welding. Specifically, a physically continuous three-dimensional network structure is preferred, of which at least the surface is made of nickel or a nickel alloy containing nickel in an amount of at least 50 wt %. For example, a porous nickel may be mentioned which is obtainable by plating nickel on a skeleton made of a foamed polymer material and then burning off the inner polymer material.

In the anode of the three-dimensional network structure, the diameter of the portion corresponding to the thread of the net constituting the network, is preferably from 0.01 to 2 mm. If the diameter is less than 0.01 mm, the production tends to be very difficult and costly, and handling is not easy, such being undesirable. If the diameter exceeds 2 mm, an anode having a large surface area tends to be hardly obtainable, and the current density at the anode surface tends to be high, whereby not only by-products such as thiosulfate ions are likely to be formed, but also dissolution of the anode is likely to take place when the anode is a metal, such being undesirable. Particularly preferably, the diameter is from 0.02 to 1 mm.

The average pore diameter of the network of the anode is preferably from 0.001 to 5 mm. If the average pore diameter of the network is larger than 5 mm, the surface area of the anode can not be made large, and the current density at the anode surface tends to be large, whereby not only by-products such as thiosulfate ions are likely to form, but also dissolution of the anode is likely to take place when a metal is employed as the anode, such being undesirable. If the average pore diameter of the network is smaller than 0.001 mm, such is not preferred, since a problem in the electrolytic operation is likely to occur, such that clogging takes place when a solid component enters into the electrolytic cell, or the pressure loss of the solution tends to be large. The average pore diameter of the network of the anode is more preferably from 0.2 to 2 mm.

In the present invention, at least the surface of the porous anode is preferably made of nickel or a nickel alloy containing nickel in an amount of at least 50 wt %. As at least the surface portion of the anode is nickel, it has practically adequate durability in the production of polysulfides. Nickel is inexpensive, and the elution potential inclusive of its oxide is higher than the formation potentials of polysulfide sulfur and thiosulfate ions. Thus, it is a material suitable for the present invention.

Further, in the present invention, the porous anode is preferably such that its surface area is from 2 to 100 $m^2/m^2$ per effective current-carrying area of the diaphragm partitioning the anode compartment and the cathode compartment. If the surface area of the anode is smaller than 2 $m^2/m^2$, the current density at the anode surface tends to be large, whereby not only by-products such as thiosulfate ions are likely to form, but also dissolution of the anode is likely to take place when the anode is a metal. If the surface area of the anode is larger than 100 $m^2/m^2$, the porous anode itself will have a high pressure loss, and the anode solution tends to hardly flow into the interior of the porous anode, whereby by-products such as thiosulfate ions are likely to form. More preferably, the surface area of the anode is from 5 to 50 $m^2/m^2$ per effective current-carrying area of the diaphragm.

The surface area of the anode per volume of the anode compartment is preferably from 500 to 20000 $m^2/m^3$. If the surface area of the anode per volume of the anode compartment is smaller than 500 $m^2/m^3$, the current density at the anode surface tends to be high, whereby not only by-products such as thiosulfate ions are likely to form, but also dissolution of the anode is likely to take place when the anode is a metal. If the surface area of the anode per volume of the anode compartment is larger than 20000 $m^2/m^3$, a problem in the electrolytic operation is likely to result, such that the pressure loss of the liquid tends to be large, such being undesirable. More preferably, the surface area of the anode per volume of the anode compartment is within a range of from 1000 to 20000 $m^2/m^3$.

It is preferred that the operation is carried out at a current density of from 0.5 to 20 $kA/m^2$ at the diaphragm area. If the current density at the diaphragm area is less than 0.5 $kA/m^2$, an unnecessarily large installation for electrolysis will be required, such being undesirable. If the current density at the diaphragm area exceeds 20 $kA/m^2$, not only by-products such as thiosulfuric acid, sulfuric acid and oxygen may increase, but also anode dissolution is likely to take place when the anode is a metal, such being undesirable. More preferably, the current density at the diaphragm area is from 2 to 15 $kA/m^2$. In the present invention, an anode having a large surface area relative to the area of the diaphragm is employed, whereby the operation can be carried out within a range where the current density at the anode surface is low.

Presuming that the current density is uniform over the entire surface of the anode, if the current density at the anode surface is calculated from the surface area of the anode, the calculated current density is preferably from 5 to 3000 $A/m^2$. More preferred range is from 10 to 1500 $A/m^2$. If the current density at the anode surface is less than 5 $A/m^2$, an unnecessarily large installation for electrolysis will be required, such being undesirable. If the current density at the anode surface exceeds 3000 $A/M^2$, not only by-products such as thiosulfuric acid, sulfuric acid and oxygen may increase, but also anode dissolution is likely to take place when the anode is a metal, such being undesirable.

In the present invention, the porous anode is disposed so that a space is provided at least partly between the porous anode and the diaphragm, whereby the pressure loss of the anode can be maintained to be small, even if the superficial velocity of the anode solution is set to be high. Further, if the average superficial velocity of the anode solution is too small, not only by-products such as thiosulfuric acid, sulfuric acid and oxygen may increase, but also anode dissolution is likely to take place when the anode is a metal, such being undesirable. The average superficial velocity of the anode solution is preferably from 1 to 30 cm/sec. More preferably, the average superficial velocity of the anode solution is from 1 to 15 cm/sec, particularly preferably from 2 to 10 cm/sec. The flow rate of the cathode solution is not limited, but is determined depending upon the degree of buoyancy of the generated gas.

In order to let the electrolytic reaction at the anode take place efficiently, it is necessary to let the liquid to be treated pass through the anode. For this purpose, the anode itself preferably has a sufficient porosity, and the porosity of the porous anode is preferably from 30 to 99%. If the porosity is less than 30%, the liquid to be treated may not pass through the interior of the anode, such being undesirable. If the porosity exceeds 99%, it tends to be difficult to enlarge the surface area of the anode, such being undesirable. It is particularly preferred that the porosity is from 50 to 98%.

An electric current is supplied to the anode through an anode current collector. The material for the current collector is preferably a material excellent in alkali resistance. For example, nickel, titanium, carbon, gold, platinum or stainless steel may be employed. The current collector is attached to the rear surface or the periphery of the anode. When the current collector is attached to the rear surface of the anode, the surface of the current collector may be flat. It may be designed to supply an electric current simply by mechanical contact with the anode, but preferably by physical contact by e.g. welding.

The material for the cathode is preferably a material having alkali resistance. For example, nickel, Raney nickel, nickel sulfide, steel or stainless steel may be used. As the cathode, one or more flat plates or meshed sheets may be used in a single or a multi-layered structure. Otherwise, a three-dimensional electrode composed of linear electrodes, may also be employed.

As the electrolytic cell, a two compartment type electrolytic cell comprising one anode compartment and one cathode compartment, may be employed. An electrolytic cell having three or more compartments combined may also be used. A plurality of electrolytic cells may be arranged in a monopolar structure or a bipolar structure.

As the diaphragm partitioning the anode compartment and the cathode compartment, it is preferred to employ a cation exchange membrane. The cation exchange membrane transports cations from the anode compartment to the cathode compartment, and prevents transfer of sulfide ions and polysulfide ions. As the cation exchange membrane, a polymer membrane having cation exchange groups such as sulfonic acid groups or carboxylic acid groups introduced to a hydrocarbon type or fluororesin type polymer, is preferred. If there will be no problem with respect to e.g. alkali resistance, e.g. a bipolar membrane or an anion exchange membrane may also be used.

The temperature of the anode compartment is preferably within a range of from 70 to 110° C. If the temperature of the anode compartment is lower than 70° C., not only the cell voltage tends to be high, but also sulfur tends to precipitate, or by-products are likely to form and anode dissolution is likely to take place when the anode is a metal, such being undesirable. The upper limit of the temperature is practically limited by the material of the diaphragm or the electrolytic cell.

The anode potential is preferably maintained within such a range that polysulfide ions ($S_x^{2-}$)such as $S_2^{2-}$, $S_3^{2-}$, $S_4^{2-}$ and $S_5^{2-}$ will form as oxidation products of sulfide ions, and no thiosulfate ions will be produced as by-products. The operation is preferably carried out so that the anode potential is within a range of from −0.75 to +0.25 V. If the anode potential is lower than −0.75 V, no substantial formation of polysulfide ions will take place, such being undesirable. If the anode potential is higher than +0.25 V, not only by-products such as thiosulfate ions are likely to form, but also anode dissolution is likely to take place when the anode is a metal, such being undesirable. In the present specification, the electrode potential is represented by a potential measured against a reference electrode of $Hg/Hg_2Cl_2$ in a saturated KCl solution at 25° C.

When the anode is a three-dimensional electrode, it is not easy to accurately measure the anode potential. Accordingly, it is industrially preferred to control the production conditions by regulating th e cell voltage or the current density at the diaphragm area, rather than by regulating the potential. This electrolytic method is suitable for constant current electrolysis. However, the current density may be changed.

The solution containing sulfide ions to be introduced into the anode compartment, is subjected to electrolytic oxidation in the anode compartment, and then, at least a part may be recycled to the same anode compartment. Otherwise, so-called one pass treatment, wherein the solution is supplied to the next step without such recycling, may be employed. When the solution containing sulfide ions is white liquor or green liquor in a pulp production process, it is preferred to supply the electrolytically oxidized white liquor or green liquor flowing out of the anode compartment to the next step without recycling it to the same anode compartment.

As counter cations to the sulfide ions in the anode solution, alkali metal ions are preferred. As the alkali metal, sodium or potassium is preferred.

The method of the present invention is suitable particularly for a method for obtaining a polysulfide cooking liquor by treating white liquor or green liquor in a pulp production process. In this specification, when white liquor or green liquor is referred to, such white liquor or green liquor includes a liquor subjected to concentration, dilution or separation of solid contents. When a polysulfide production process of the present invention is combined in the pulp production process, at least a part of white liquor or green liquor is withdrawn and treated by the polysulfide production process of the present invention, and the treated liquor is then supplied to a cooking process.

The composition of the white liquor usually contains from 2 to 6 mol/l of alkali metal ions in the case of white liquor used for current kraft pulp cooking, and at least 90% thereof is sodium ions, the rest being substantially potassium ions. Anions are mainly composed of hydroxide ions, sulfide ions and carbonate ions, and further include sulfate ions, thiosulfate ions, chloride ions and sulfite ions. Further, very small amount components such as calcium, silicon, aluminum, phosphorus, magnesium, copper, manganese and iron, are contained.

On the other hand, the composition of the green liquor contains, while the white liquor contains sodium sulfide and sodium hydroxide as the main components, sodium sulfide and sodium carbonate as the main components. Other anions and very small amount components in the green liquor are the same as in the white liquor.

When such white liquor or green liquor is supplied to the anode compartment and subjected to electrolytic oxidation according to the present invention, the sulfide ions are oxidized to form polysulfide ions. At the same time, alkali metal ions will be transported through the diaphragm to the cathode compartment.

To be used for the pulp cooking process, the PS-S concentration in the solution (polysulfide cooking liquor) obtained by electrolysis is preferably from 5 to 15 g/l, although it depends also on the sulfide ion concentration in the white liquor or the green liquor. If the PS-S concentration is less than 5 g/l, no adequate effect for increasing the yield of pulp by cooking may be obtained. If the PS-S concentration is higher than 15 g/l, the $Na_2S$-state sulfur content tends to be small, whereby the yield of pulp will not increase, and thiosulfate ions tend to be produced as by-products during the electrolysis. Further, if the average value of x of the polysulfide ions ($S_x^{2-}$) exceeds 4, thiosulfate ions likewise tend to be formed as by-products during the electrolysis, and the anode dissolution is likely to take place when the anode is a metal. Accordingly, it is preferred to carry out the electrolytic operation so that the average value of x of the polysulfide ions in the cooking liquor will be at most 4, particularly at most 3.5. The conversion (degree of conversion) of the sulfide ions to PS-S is preferably from 15% to 75%, more preferably at most 72%.

The reaction in the cathode compartment may be selected variously. However, it is preferred to utilize a reaction to form hydrogen gas from water. An alkali hydroxide will be formed from the hydroxide ion formed as a result and the alkali metal ion transported from the anode compartment. The solution to be introduced into the cathode compartment is preferably a solution consisting essentially of water and an alkali metal hydroxide, particularly a solution consisting of water and hydroxide of sodium or potassium. The concentration of the alkali metal hydroxide is not particularly limited, but is, for example, from 1 to 15 mol/l, preferably from 2 to 5 mol/l. It is possible to prevent deposition of insolubles on the diaphragm if a solution having an ionic strength lower than the ionic strength of the white liquor passing though the anode compartment is used as the cathode solution, although such may depend on the particular case.

Now, the present invention will be described in further detail with reference to Examples. However, it should be understood that the present invention is by no means restricted to such specific Examples.

EXAMPLE 1

A two compartment electrolytic cell was assembled as follows. To a current collector plate of nickel, a nickel foam (Cellmet, tradename, manufactured by Sumitomo Electric Industries, Ltd., 100 mm in height×20 mm in width×4 mm in thickness) as an anode, was electrically welded. A meshed Raney nickel as a cathode, and a fluororesin type cation exchange membrane (Flemion, tradename, manufactured by Asahi Glass Company, Limited) as a diaphragm, were prepared. An anode compartment frame having a thickness of 5 mm was put on the anode, and the diaphragm, the cathode, a cathode compartment frame having a thickness of 5 mm and a cathode compartment plate, were overlaid in this order and pressed and fixed. The shape of the anode compartment was such that the height was 100 mm, the width was 20 mm and the thickness was 5 mm, and the shape of the cathode compartment was such that the height was 100 mm, the width was 20 mm and the thickness was 5 mm. The effective area of the diaphragm was 20 $cm^2$. During the electrolytic operation, both the anode solution and the cathode solution were permitted to flow from the bottoms upwards in the height direction of the respective components, and the pressure was made higher at the anode compartment side than at the cathode compartment side to press the diaphragm against the cathode and to secure a space having a thickness of 1 mm between the anode and the diaphragm. The physical properties of the anode and the electrolytic conditions, etc., were as follows.

Thickness of anode compartment: 5 mm

Thickness of anode: 4 mm

Ratio of apparent volume of anode to volume of anode compartment: 80%

Porosity of anode compartment: 96%

Average superficial velocity of liquid in anode compartment: 4 cm/sec

Surface area of anode per volume of anode compartment: 5600 $M^2/m^3$

Average pore size of network: 0.51 mm

Surface area to diaphragm area: 28 $m^2/m^2$

Electrolysis temperature: 85° C.

Current density at diaphragm: 6 $kA/m^2$

As an anode solution, 1 l of model white liquor ($Na_2S$: 16 g/l as calculated as sulfur atom, NaOH: 90 g/l, $Na_2CO_3$: 34 g/l) was prepared, and circulated at a flow rate of 240 ml/min (average superficial velocity in anode compartment: 4 cm/sec) by introducing it from the lower side of the anode compartment and withdrawing it from the upper side. 2 l of a 3N:NaOH aqueous solution was used as a cathode solution, and it was circulated at a flow rate of 80 ml/min (superficial velocity: 1.3 cm/sec) by introducing it from the lower side of the cathode compartment and with drawing it from the upper side. On both anode side and cathode side, heat exchangers were provided, so that the anode solution and the cathode solution, were heated and then introduced to the cell.

Constant current electrolysis was carried out at a current of 12 A (current density at the diaphragm: 6 $kA/m^2$) to prepare a polysulfide cooking liquor. At predetermined times, the cell voltage was measured, and the circulated liquid was sampled, whereupon PS-S, sulfide ions and thiosulfate ions in the solution were quantitatively analyzed. The analyses were carried out in accordance with the methods disclosed in JP-A-7-92148.

The changes with time of the quantitatively analyzed values of the concentrations of various sulfur compounds and the measured values of the cell voltage were as follows. After 1 hour and 30 minutes from the initiation of the electrolysis, the composition of the polysulfide cooking liquor was such that PS-S was 10.0 g/l, $Na_2S$ was 5.4 g/l as calculated as sulfur atom, and the increased thiosulfate ions were 0.64 g/l as calculated as sulfur atom, and the average value of x of the polysulfide ions ($S_x^{2-}$) was 2.9. The current efficiency of PS-S during that time was 89%, and the selectivity was 94%.

After 1 hour and 30 minutes from the initiation of the electrolysis, side reactions started to proceed gradually, the polysulfide ions ($S_x^{2-}$) decreased while maintaining the average value of x of about 4, and formation reaction of the thiosulfate ions proceeded. Then, after about 2 hours and 30 minutes, the cell voltage suddenly increased, and nickel eluted.

The cell voltage was stable at about 1.3 V from the initiation of the electrolysis for about 1 hour, and then the cell voltage gradually increased. It was 1.4 V after about 1 hour and 40 minutes when the thiosulfate ion concentration increased, and when 1 hour further passed, the voltage increased to about 2 V and the elution reaction of nickel started to proceed. During the electrolytic operation, the pressure loss of the anode was 0.12 kgf/cm$^2$/m.

The "current efficiency" and the "selectivity" are defined by the following formulae, wherein A (g/l) is the concentration of PS-S formed, and B (g/l) is the concentration of thiosulfate ions formed, as calculated as sulfur atom. During the electrolytic operation, until the nickel elution reaction starts, only PS-S and thiosulfate ions will be formed, and accordingly the following definitions should be permissible.

$$\text{Current efficiency}=[A/(A+2B)]\times 100\%$$

$$\text{Selectivity}=[A/(A+B)]\times 100\%$$

In each Example, an elution reaction of the nickel foam was observed. Therefore, evaluation of the nickel elution was represented by the following indices.

×: Nickel eluted before the average value of x of polysulfide ions ($S_x^{2-}$) became 2 or PS-S became 8 g/l.

○: Nickel eluted when the average value of x of the polysulfide ions ($S_x^{2-}$) became 3.6 or when the electrolysis reaction was about to shift from the PS-S formating reaction to the thiosulfate ion-forming reaction.

◎: Nickel eluted after the electrolysis reaction shifted to the thiosulfate ion-forming reaction, or nickel did not elute.

In Table 1, "Initial cell voltage" represents a voltage value in a constant stabilized state after the initiation of the electrolysis. For example, in Example 1, the cell voltage was stable at 1.3 V from the initiation of the electrolysis to about 1 hour. This voltage value is referred to as "Initial cell voltage".

EXAMPLES 2 to 4

Constant current electrolysis was carried out in the same manner as in Example 1 under conditions that the apparent volume of the anode to the volume of the anode compartment was changed by changing the thickness of the anode compartment frame. The physical properties of the anode and the results of the electrolysis in each Example are shown in Table 1. Like in Example 1, PS-S was formed at a current efficiency of about 85% and with a selectivity of about 90%, and upon expiration of 1 hour and 30 minutes from the initiation of the electrolysis, it was possible to obtain a polysulfide cooking liquor having a PS-S concentration exceeding 10 g/l. Thereafter, also like in Example 1, when the average value of x of the polysulfide ions ($S_x^{2-}$) became about 4, the polysulfide ions started to decrease, while maintaining the average value, and thiosulfate ions started to form. The initial cell voltage increased by the liquid resistance as the distance between the anode and the diaphragm increased. Evaluation of the nickel elution was as shown in Table 1.

COMPARATIVE EXAMPLE 1

Constant current electrolysis was carried out in the same manner as in Example 1 except that the thickness of the anode compartment frame was changed to 4 mm, and no space was provided between the anode and the diaphragm. The physical properties of the anode and the results of the electrolysis at that time, are shown in Table 1. The polysulfide ions and the thiosulfate ions were formed at a high current efficiency like in Examples 1 to 4. The evaluation of nickel elution was ◎, but the elution reaction took place in an electrolysis time earlier than Examples 1, 2 and 4. Further, the pressure loss was large at a level of 0.28 kgf/cm$^2$/m, as compared with the Examples of the present invention.

COMPARATIVE EXAMPLE 2

Constant current electrolysis was carried out in the same manner as in Example 1 except that the thickness of the anode compartment frame was changed to 7 mm, and the space between the anode and the diaphragm was 3 mm. The physical properties of the anode and the results of the electrolysis at that time are shown in Table 1. From the initial stage of the electrolysis, the current efficiency was low at 70%, and the selectivity was low at 75%, and nickel eluted before PS-S became high concentration. Further, the initial cell voltage was substantially higher than in Examples 1 to 4.

TABLE 1

| Example No. | Apparent volume of anode to volume of anode compartment (%) | Surface area of anode per volume of anode compartment (m$^2$/m$^3$) | Porosity of anode compartment (%) | Evaluation of nickel elution | Pressure loss in anode compartment (kgf/cm$^2$/m) | Initial cell voltage (V) |
|---|---|---|---|---|---|---|
| Ex. 1 | 80 | 5600 | 96.0 | ◎ | 0.12 | 1.3 |
| Ex. 2 | 73 | 5091 | 96.3 | ◎ | 0.09 | 1.5 |
| Ex. 3 | 67 | 4667 | 96.7 | ○ | 0.06 | 1.6 |
| Ex. 4 | 90 | 6220 | 95.6 | ◎ | 0.20 | 1.2 |
| Comp. Ex. 1 | 100 | 7000 | 95.0 | ◎ | 0.28 | 1.1 |
| Comp. Ex. 2 | 50 | 3500 | 97.5 | X | 0.02 | 2.0 |

EXAMPLES 5 to 8

Constant current electrolysis was carried out in the same manner as in Example 1 except that the superficial velocity of the anode solution was set to be 2.0 cm/sec. Further, like in Examples 1 to 4, the apparent volume of the anode to the volume of the anode compartment was changed by changing the thickness of the anode compartment frame, and the results thereby obtained are shown in Table 2. In each Example, the current efficiency was at least 85%, the selectivity was at least 89%, and a polysulfide cooking liquor having a PS-S concentration exceeding 10 g/l was obtained. With respect to Examples 5 to 7, a good evaluation of nickel elution was obtained. In Example 8 wherein the space width was 2 mm, nickel eluted slightly earlier.

COMPARATIVE EXAMPLE 3

Constant current electrolysis was carried out in the same manner as in Examples 5 to 8 except that the thickness of the anode compartment frame was changed to 4 mm, and no space was provided between the anode and the diaphragm. The polysulfide ions and the thiosulfate ions were formed at a high current efficiency like in Examples 5 to 8. Evaluation of nickel elution was ⊙, but the elution reaction took place in an electrolysis time earlier than in Examples 5 to 7. Further, the pressure loss was large at a level of 0.10 kgf/cm$^2$/m as compared with the Examples.

COMPARATIVE EXAMPLES 4

Constant current electrolysis was carried out in the same manner as in Examples 5 to 8 except that the thickness of the anode compartment frame was changed to 7 mm, and the space between the anode and the diaphragm was 3 mm. From the initial stage of the electrolysis, the current efficiency was low at 60%, the selectivity was low at 64%, and nickel eluted before PS-S became high concentration. Further, the initial cell voltage was substantially higher than in Examples 1 to 4.

TABLE 2

| Example No. | Apparent volume of anode to volume of anode compartment (%) | Surface area of anode per volume of anode compartment (m$^2$/m$^3$) | Porosity of anode compartment (%) | Evaluation of nickel elution | Pressure loss in anode compartment (kgf/cm$^2$/m) | Initial cell voltage (V) |
|---|---|---|---|---|---|---|
| Ex. 5 | 90 | 6220 | 95.6 | ⊙ | 0.07 | 1.40 |
| Ex. 6 | 80 | 5600 | 96.0 | ⊙ | 0.05 | 1.45 |
| Ex. 7 | 73 | 5091 | 96.3 | ⊙ | 0.03 | 1.55 |
| Ex. 8 | 67 | 4667 | 96.7 | ○ | 0.01 | 1.65 |
| Comp. Ex. 3 | 100 | 7000 | 95.0 | ⊙ | 0.10 | 1.28 |
| Comp. Ex. 4 | 57 | 4000 | 97.1 | X | 0.01 | 1.73 |

EXAMPLE 9

Constant current electrolysis was carried out in the same manner as in Example 1 except that the current density per effective current-carrying area of the diaphragm was set to be 8 kA/m$^2$. The results are shown in Table 3. The current efficiency was 80%, the selectivity was 84%, and a polysulfide cooking liquor having a PS-S concentration exceeding 10 g/l, was obtained. Evaluation of the nickel elution was ○.

EXAMPLE 5

Constant current electrolysis was carried out in the same manner as in Comparative Example 1 except that the current density per effective current-carrying area of the diaphragm was set to be 8 kA/m$^2$. Example 9 and Comparative Example 5 are different only in the apparent volume of the anode to the volume of the anode compartment. The results are shown in Table 3. When a PS-S solution having a concentration of 10 g/l, was produced, the current efficiency was 82%, and the selectivity was 85%. Evaluation of the nickel elution was ○ like in Example 9, but elution started slightly earlier than in Example 9. Further, the pressure loss was as high as twice or more than in Example 9.

TABLE 3

| Example No. | Apparent volume of anode to volume of anode compartment (%) | Surface area of anode per volume of anode compartment (m$^2$/m$^3$) | Porosity of anode compartment (%) | Superficial velocity in anode compartment (cm/s) | Evaluation of nickel elution | Pressure loss in anode compartment (kgf/cm$^2$/m) | Initial cell voltage (V) |
|---|---|---|---|---|---|---|---|
| Ex. 9 | 80 | 5600 | 96.0 | 4.0 | ○ | 0.12 | 1.55 |
| Comp. Ex. 5 | 100 | 7000 | 95.0 | 4.0 | ○ | 0.28 | 1.35 |

EXAMPLE 10

For th e purpose of obtaining a cooking liquor having a high PS-S concentration by on e pass treatment, a two compartment electrolytic cell of 1 m in height×20 mm in width×5 mm in thickness having a structure similar to the electrolytic cell used in Example 1 but different in height, was assembled. The effective area of the diaphragm was 200 cm$^2$, and a space with a width of 1 mm was provided between the diaphragm and the anode in the anode compartment. To maintain this space, the anode side was set to be pressurized. The physical properties of the anode and the electrolysis conditions, etc., were the same as in Example 1.

As an anode solution, white liquor made in a pulp plant (containing 21 g/l of $Na_2S$ as calculated as sulfur atom) was passed from the lower side of the anode compartment at a flow rate of 120 ml/min (average superficial velocity in anode compartment: 2 cm/sec) by one pass. As a cathode solution, a 3N:NaOH aqueous solution was used, and it was circulated at a flow rate of 80 ml/min (superficial velocity: 1.3 cm/sec) by introducing it from the lower side of the cathode compartment and withdrawing it from the upper side. To the cathode solution tank, water was quantitatively added to let the cathode solution overflow and to maintain the NaOH concentration of the cathode solution to be constant. At both the anode side and the cathode side, heat exchangers were provided, so that the anode solution and the cathode solution were heated and then introduced into the cell.

The composition of the polysulfide cooking liquor withdrawn from the electrolytic cell was examined, whereby PS-S was 9.3 g/l, $Na_2S$ was 10.9 g/l as calculated as sulfur atom, increased thiosulfate ions were 1.15 g/l as calculated as sulfur atom, and the average value of x of the polysulfide ions ($S_x^{2-}$) was 1.9. During this period, the current efficiency of PS-S was 93%, and the selectivity was 97%. The white liquor in the pulp production process contains sulfite ions, and the sulfite ions will react with polysulfide ions as shown by the following formula 4 to form thiosulfate ions.

$$Na_2S_x+(x+1)Na_2SO_3 \rightarrow Na_2S+(x-1)\ Na_2S_2O_3 \quad (4)$$

The sulfite ion concentration in the white liquor was 0.4 g/l as calculated as sulfur atom. Accordingly, the PS-S concentration reduced by the sulfite ions was 0.4 g/l, and the thiosulfate ion concentration as calculated as sulfur atom, formed by the reaction of the sulfite ions with PS-S, was 0.8 g/l. Accordingly, in the above calculation of the current efficiency and the selectivity, calculation was carried out on the basis that the PS-S concentration (A) was (9.3+0.4) g/l, and the thiosulfate ion concentration (B) was (1.15−0.8) g/l.

The cell voltage was about 1.2 V, and the pressure loss of the anode was 0.07 kgf/cm$^2$/m. Further, the nickel concentration in the polysulfide cooking liquor was analyzed, whereby it was found to be the same as the nickel concentration contained in the white liquor before introduction into the electrolytic cell, and no elution of nickel took place.

INDUSTRIAL APPLICABILITY

According to the present invention, a cooking liquor containing a high concentration of polysulfide sulfur and having a large amount of remaining $Na_2S$ state sulfur can be produced with little by-production of thiosulfate ions, while maintaining a high selectivity. By employing the polysulfide cooking liquor thus obtained for cooking, yield of pulp can effectively be increased. Further, the pressure loss during the electrolytic operation can be minimized, and clogging with SS (suspended substances) can be suppressed.

The entire disclosure of Japanese Patent Application No. 11-051033 filed on Feb. 26, 1999 including specification, claims and summary are incorporated herein by reference in its entirety.

What is claimed is:

1. A method for producing polysulfides, which comprises:

in an electrolytic cell having an anode compartment provided with a porous anode, a cathode compartment provided with a cathode, and a diaphragm which partitions the anode compartment and the cathode compartment, wherein the porous anode is positioned in the anode compartment so as to provide a space at least partly between the porous anode and the diaphragm such that the apparent volume of the porous anode ranges from 60% to 90% based on the volume of the anode compartment, introducing a solution containing sulfide ions into the anode compartment; and conducting electrolysis in the electrolytic cell so as to form polysulfide ions in the solution of the anode compartment.

2. The method for producing polysulfides according to claim 1, wherein the porous anode has a physically continuous three dimensional network structure.

3. The method for producing polysulfides according to claim 2, wherein the porous anode is such that at least its surface is made of nickel or a nickel alloy containing nickel in an amount of at least 50 wt %.

4. The method for producing polysulfides according to claim 3, wherein the surface area of the porous anode is from 2 to 100 m$^{2/m2}$ per effective current-carrying area of the diaphragm.

5. The method for producing polysulfides according to claim 4, wherein the electrolysis is carried out under a condition such that the pressure in the anode compartment is higher than the pressure in the cathode compartment.

6. The method for producing polysulfides according to claim 3, wherein the electrolysis is carried out under a condition such that the pressure in the anode compartment is higher than the pressure in the cathode compartment.

7. The method for producing polysulfides according to claim 2, wherein a diameter of a portion corresponding to a thread of a net constituting the network is from 0.01 to 2 mm.

8. The method for producing polysulfides according to claim 7, wherein the diameter is from 0.02 to 1 mm.

9. The method for producing polysulfides according to claim 2, wherein an average pore diameter of the network of the anode is from 0.001 to 5 mm.

10. The method for producing polysulfides according to claim 9, wherein the average pore diameter is from 0.2 to 2 mm.

11. The method for producing polysulfides according to claim 1, wherein the surface area of the porous anode is from 2 to 100 m$^2$/m$^2$ per effective current-carrying area of the diaphragm.

12. The method for producing polysulfides according to claim 11, wherein the electrolysis is carried out under a condition such that the pressure in the anode compartment is higher than the pressure in the cathode compartment.

13. The method for producing polysulfides according to claim 1, wherein the electrolysis is carried out under a condition such that the pressure in the anode compartment is higher than the pressure in the cathode compartment.

14. The method for producing polysulfides according to claim 1, wherein the current density in the electrolysis is from 0.5 to 20 kA/m$^2$ per effective current-carrying area.

15. The method for producing polysulfides according to claim 1, wherein the solution containing sulfide ions, is made to pass through the anode compartment at an average superficial velocity of from 1 to 30 cm/sec.

16. The method for producing polysulfides according to claim 1, wherein the solution containing sulfide ions is white liquor or green liquor in a pulp production process.

17. The method for producing polysulfides according to claim 16, further comprising withdrawing liquid from the anode compartment containing polysulfide product as an electrolytically oxidized white liquor or green liquor which is then supplied to a next step of processing without recycling the liquid to the anode compartment.

18. The method for producing polysulfides according to claim 1, wherein the apparent volume of the porous anode is from 70 to 99%.

19. The method for producing polysulfides according to claim 1, wherein said anode has a surface area per volume of the anode compartment of from 500 to 20,000 $m^2/m^3$.

20. The method for producing polysulfides according to claim 1, wherein said porous anode has a porosity of from 30 to 99%.

21. The method for producing polysulfides according to claim 20, wherein said porosity is from 50 to 98%.

22. The method for producing polysulfides according to claim 1, wherein said cathode comprises a material having alkali resistance.

23. The method for producing polysulfides according to claim 22, wherein said cathode comprises nickel, Raney nickel, nickel sulfide, steel or stainless steel.

24. The method for producing polysulfides according to claim 1, wherein the diaphragm partitioning the anode compartment and the cathode compartment is a cation exchange membrane.

25. The method for producing polysulfides according to claim 1, wherein said porous anode comprises carbon fibers, carbon felts, carbon papers, metal foams, meshed metals or meshed carbon.

26. The method for producing polysulfides according to claim 1, wherein said porous anode comprises a metal electrode having platinum applied to a surface thereof.

* * * * *